US005808251A

United States Patent [19]

McGlone

[11] Patent Number: 5,808,251

[45] Date of Patent: Sep. 15, 1998

[54] OPERATION SELECTOR FOR SWITCHGEAR

[75] Inventor: Buddy B. McGlone, Lombard, Ill.

[73] Assignee: S&C Electric Company, Chicago, Ill.

[21] Appl. No.: 705,442

[22] Filed: Aug. 29, 1996

[51] Int. Cl.[6] ..... H01H 3/00; H01H 9/28; H01H 31/00

[52] U.S. Cl. ..... 200/50.01; 200/17 R; 200/43.14

[58] Field of Search ..... 200/17 R, 18, 200/43.14, 50.01, 318

[56] References Cited

U.S. PATENT DOCUMENTS

| | | | |
|---|---|---|---|
| 4,210,788 | 7/1980 | Stranczek | 200/42 T |
| 5,034,575 | 7/1991 | Stewart | 200/11 R |
| 5,034,584 | 7/1991 | Fanta et al. | 200/329 |
| 5,268,543 | 12/1993 | Ramos | 200/43.11 |
| 5,504,293 | 4/1996 | Rogers et al. | 218/154 |

*Primary Examiner*—Renee S. Luebke
*Assistant Examiner*—Michael J. Hayes
*Attorney, Agent, or Firm*—James V. Lapacek

[57] ABSTRACT

An operation selector arrangement is provided for an operating mechanism that is controlled by movement of an operating shaft between the operational positions. Blocking features are provided for preventing operation between predetermined operational positions without first manipulating the blocking features. In a preferred arrangement, a an operating handle is utilized to operate the operation selector arrangement. A blocking member prevents operation of an operation selector between two operating positions without first stopping at an intermediate position, removing the operating handle, moving the blocking member, and then reinserting the handle. The blocking member is separately securable from the operation selector such that personnel may be authorized to operate the operation selector while other personnel are additionally authorized to manipulate the blocking member.

11 Claims, 4 Drawing Sheets

OPERATION SELECTOR FOR SWITCHGEAR

BACKGROUND OF THE INVENTION

1. Field of the Invention

The present invention relates generally to switchgear for the field of electrical power distribution, and more particularly to operation selectors to control the operation of an operating mechanism for a switch of the switchgear, e.g. closed, open and ground positions of the switch 2. Description of the Related Art Various operating controls for switchgear are furnished to appropriately select, control, and sequence the position of one or more switches and the relationship between the operating position of the switch and an access door or control component. Controls which appropriately sequence opening and closing of a switch with the opened/closed status of an access door are commonly known as interlocks.

While the prior art arrangements may be useful to provide operational controls and interlocks for various switchgear arrangements, the prior arrangements do not provide simple and effective operation selectors with blocking features for the operation of multiple position switches.

SUMMARY OF THE INVENTION

Accordingly, it is a principal object of the present invention to provide operation selectors for switchgear operating mechanism to prevent inadvertent operation directly between predetermined operating positions without first stopping at an intermediate operating position and performing an additional procedure.

It is another object of the present invention to provide an operation selector arrangement which includes an operation selector and features for blocking operation between some operational positions, the features for blocking operation having security capabilities separate from security capabilities on the operation selector such that the blocking features can remain secured while the operation selector can be rendered operational after removal of the security provisions.

It is a further object of the present invention to provide an operation selector with a blocking member such that operation is permitted between two adjacent operational positions while operation between non-adjacent operational positions is prevented.

These and other objects of the present invention are efficiently achieved by the provision of an operation selector arrangement for an operating mechanism that is controlled by movement of an operating shaft between the operational positions. Blocking features are provided for preventing operation between predetermined operational positions without first manipulating the blocking features. In a preferred arrangement, a an operating handle is utilized to operate the operation selector arrangement. A blocking member prevents operation of an operation selector between two operating positions without first stopping at an intermediate position, removing the operating handle, moving the blocking member, and then reinserting the handle. The blocking member is separately securable from the operation selector such that personnel may be authorized to operate the operation selector while other personnel are additionally authorized to manipulate the blocking member.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
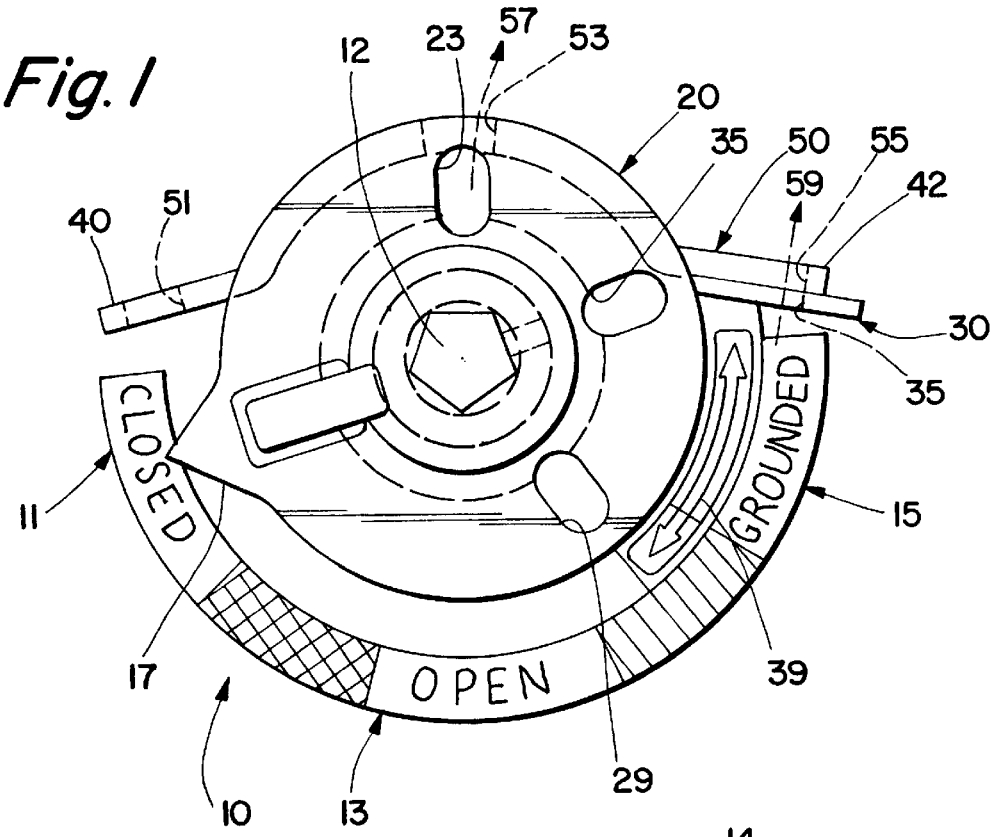
FIG. 1 is a top plan view of the operation selector arrangement of the present invention in a closed operational position.
Figure 2:
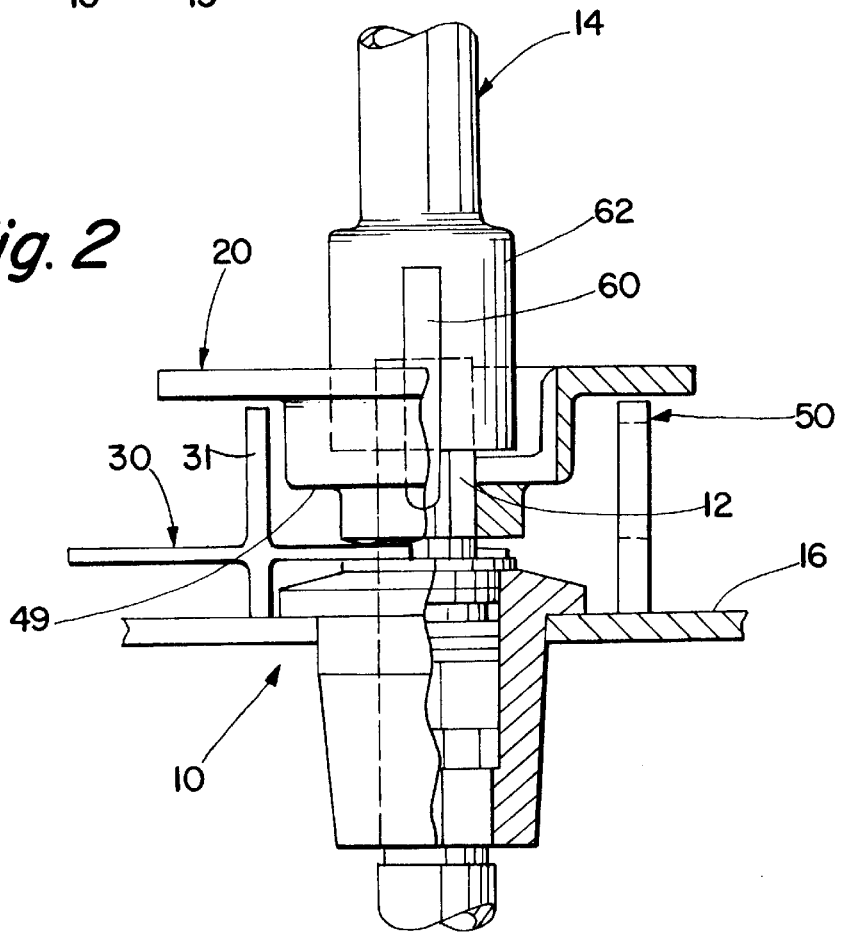
FIG. 2 is a front elevational view of FIG. 1 partly in section and with parts cut away for clarity and with the operation selector in an open operational position.
Figure 3:
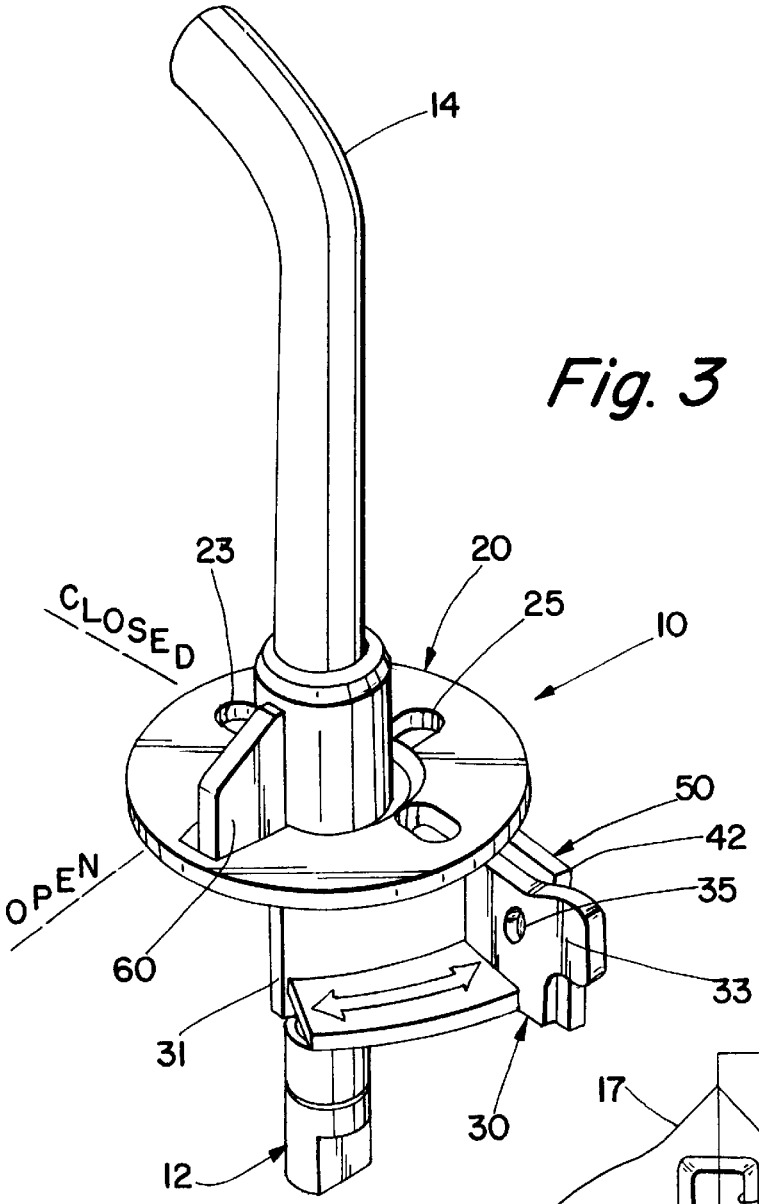
FIG. 3 is a perspective view of the operation selector arrangement of FIGS. 1 and 2, and with the operation selector in an open operational position.
Figure 4:
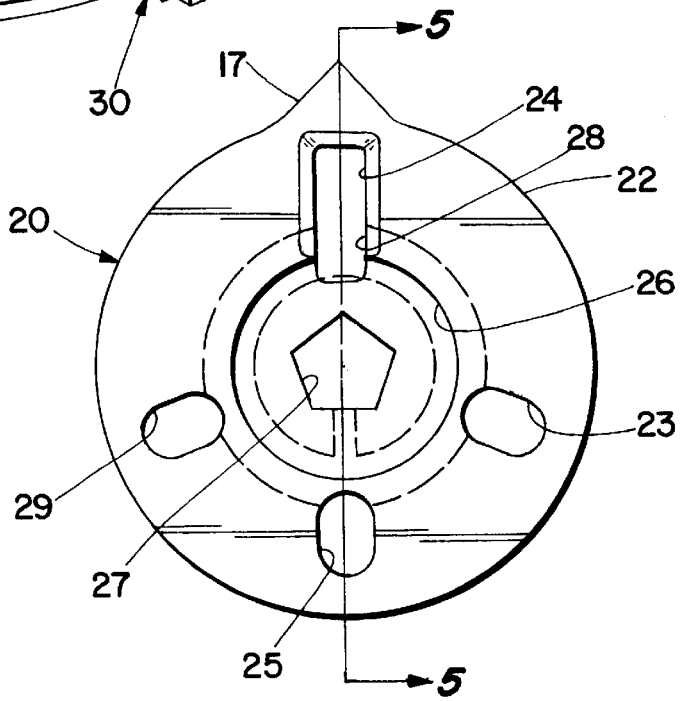
FIG. 4 is a top plan view of an operation selector disc of the operation selector arrangement of FIGS. 1–3.
Figure 5:
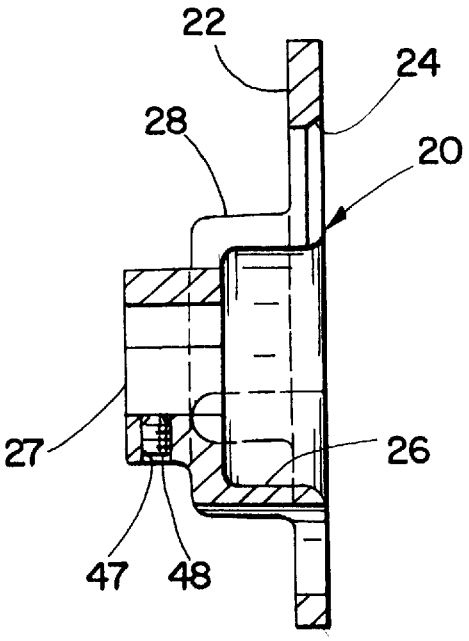
FIG. 5 is a sectional view taken from the line 5—5 of FIG. 4.
Figure 6:
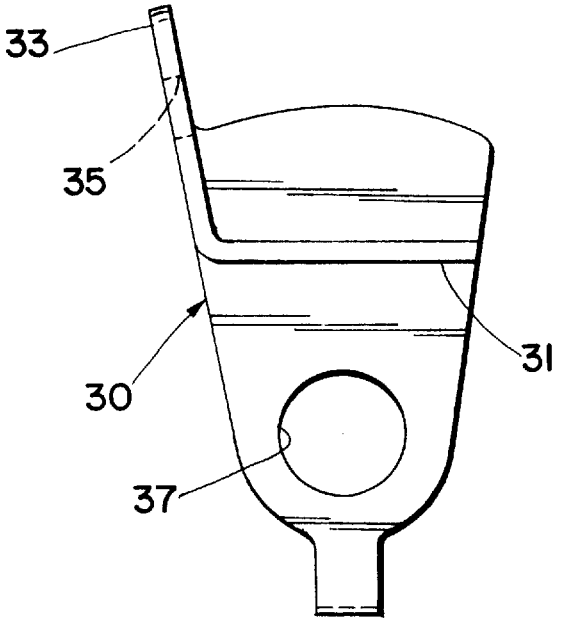
FIG. 6 is a top plan view of a blocking member of the operation selector arrangement of FIGS. 1–3.
Figure 7:
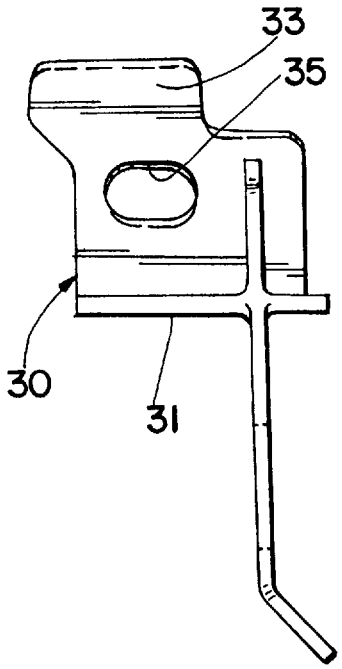
FIG. 7 is a left-side elevational view of the blocking member of FIG. 5.
Figure 8:
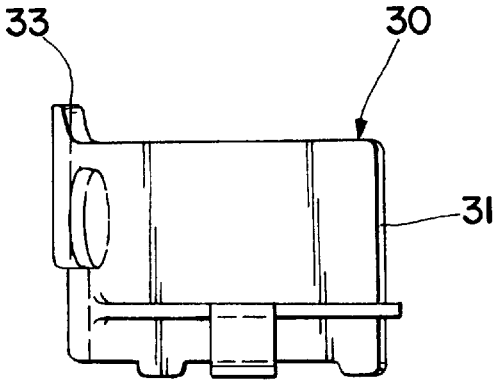
FIG. 8 is a front elevational view of the blocking member of FIG. 6.
Figure 9:
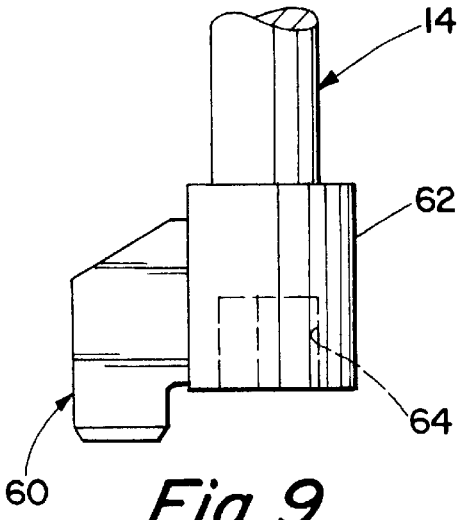
FIG. 9 is a partial front elevational view of an operating handle for operating the operation selector arrangement of FIGS. 1–8.

Referring now to FIGS. 1–3, the operation selector arrangement 10 of the present invention controls the operational state of an operating shaft 12, which may also be characterized as an operating member, via the manual manipulation of an operating handle 14 (FIGS. 2, 3). For example, in one specific embodiment, the operating shaft 12 is rotatable with respect to a housing 16 between three operating positions to control an operating mechanism (not shown) of the type illustrated in U.S. Pat. Nos. 5,521,567 and 5,504,293 and co-pending application Ser. Nos. 08/653,176 filed on May 24, 1996 in the names of B. B. McGlone et al. and (attorney docket reference case SC-5270). In the illustrative example, the three operating positions correspond to the closed, open, and grounded operational states of a switch (not shown) driven by the operating mechanism, these operating positions being illustrated in FIGS. 1 and 3 by the corresponding indicia and referred to generally at 11, 13 and 15 respectively. In FIG. 1, the operation selector arrangement 10 is shown in the closed position as indicated by the pointer feature 17.

In accordance with important aspects of the present invention, the operation selector arrangement 10 prevents inadvertent operation directly between the closed and grounded positions, the operation selector arrangement 10 requiring that operation first be stopped in the open position and a predetermined action be taken before the operating handle 14 can be utilized to rotate the operating shaft 12 to the next position, as will be explained in more detail hereinafter. For example, in an illustrative example, the operating handle 14 can be utilized to rotate the operating shaft 12 directly between the closed (11) and open (13) positions and directly between the grounded (15) and open (13) positions. However, operation directly between the grounded (15) and closed (11) positions is not possible. The operation selector arrangement 10 requires that the operating handle 14 first be removed, a positive manipulation of components accomplished, and then the operating handle 14 reinserted before any operation is permitted to rotate the operating shaft 12 from the open to grounded or open to closed positions.

In a preferred arrangement, the operation selection arrangement 10 includes an operation selector disc 20, which may also be characterized as an operation selector member and which interfits with the operating handle 14 in a predetermined orientation, e.g. via a slot 24 in the operating selector disc 20 and a web 60 extending from the operating handle 14. A blocking member 30 (best seen in FIG. 3) limits the range of rotational movement of the operation selector disc 20 in combination with two end stops 40, 42 (FIG. 1). The blocking member 30 is movable so as to function in respective grounded and closed positions to block movement of the operating shaft 12 via the operating handle 14 into the respective grounded and closed operational positions. In FIGS. 1 and 3, the blocking member 30 is in the grounded position, thus blocking operation of the operating shaft 12 and the operation selector disc 20 into the grounded position. In FIG. 2, the blocking member 30 is shown in the closed position wherein it prevents rotation of the operating shaft 12 into the closed position. As shown in FIG. 3, the blocking member 30 includes a an extending tab portion 33 for the convenient grasping by the hand and movement of the blocking member 30.

In the closed position of FIG. 1, with the operating handle 14 inserted into the operation selector disc 20, the operating shaft 12 may be rotated into the open position as shown in FIGS. 2 and 3. However, if an attempt is made to move the operating handle from the open position of FIGS. 2 and 3 into the grounded position, the blocking member via a surface 31 (FIG. 3) prevents movement of the operating handle 14 and the operation selector disc 20. Thus, before the operating shaft 12 can be rotated into the grounded position, the operating handle 14 must be removed from the operation selector disc 20, the blocking member 30 moved from the grounded position into the closed position, and the operating handle 14 reinserted, whereupon the operating shaft 12 may now be rotated into the grounded position. In a specific embodiment as shown in FIG. 1, the blocking member 30 carries indicia at 39, for example, a double-ended arrow symbol, to provide visually perceptible indication to the user as to the location of the blocking member 30.

In accordance with additional features of the present invention, the operation selector arrangement 10 may be locked in the various operating positions, and further and independently, the blocking member 30 may be locked in either the grounded or closed position. For example, in the illustrative embodiment of FIGS. 1–3, the operation selector disc 20 includes holes 23, 25 and 29 which may be aligned in the various operational positions with a hole 53 in the stop ring 50. A shackle of a padlock or the like may be inserted through one of the aligned holes 23, 25, or 29 and the hole 53 referred to at 57 whereupon rotation of the operation selector disc 20 is prevented into other operational positions. Thus, when so locked, operation of the operation selector arrangement 10 between positions is prevented. For example, as shown in FIG. 1, placing a shackle of a lock at 57 through the holes 23 and 53 locks the operation selector arrangement 10 in the closed position. Additionally, the blocking member 30 includes a hole 35 that is aligned for cooperation with a hole 55 in the end stop 42 when the blocking member 30 is in the grounded position. Thus, placing a shackle of a lock or the like as referenced at 59 locks the blocking member 30 in the grounded position. Thus, until unlocked, the blocking member 30 can not be moved out of the grounded position and the operation selector arrangement may not be operated to rotate the operating shaft 12 into the grounded operational position, i.e. even though unlocked at 23, 53.

Turning now to a more detailed discussion of the structure and operation of the operation selector arrangement 10 and referring now additionally to FIGS. 4–10, the operation selector disc 20 (shown in more detail in FIGS. 4 and 5) extends over and is affixed to the operating shaft 12. The operation selector disc 20 and the operating handle 14 (shown in more detail in FIGS. 9 and 10) are arranged to interfit in a single predetermined relative orientation via the cooperation of the slot 24 of the operation selector disc 20 and the web 60 of the operating handle 14. The blocking member 30 (shown in more detail in FIGS. 6–8) is arranged below the operation selector disc 20 so as to freely pivot about the operation selector disc 20 and the operating shaft 12. The blocking member includes a central passage 37 for mounting thereof about the operating shaft 12. Rotation of the blocking member 30 is defined in a predetermined range by means of end point stops 40, 42, for example by means of a stop ring 50 (FIGS. 1–3) affixed to the housing 16 to establish the end stop points 40, 42. Specifically, the operation selector disc 20 includes a central hub portion 26 with a passage 27 to interfit with the operating shaft 12. The operation selector disc 20 also includes a rim 22 with an aperture slot 24 defined therethrough, which also extends through the central hub portion 26 of the operation selector disc 20 at 28. Further, the web portion 60 of the operating handle 14 protrudes from and extends below the circular hub 62 of the operating handle 14, the hub 62 also including a socket 64 to interfit with the cross-section of the operating shaft 12.

In the illustrative embodiment, the cross-section of the operating shaft 12 is a pentagon. so as to avoid use other than with authorized tools such as the operating handle 14. In one specific embodiment, the operating shaft 12 above the point referred to at 49 in FIG. 2 has a round (rather than pentagonal) cross-section smaller than the pentagonal cross-section of the lower portion of the operating shaft. In that specific embodiment, the operating shaft 12 is then driven through the operating selector disc 20 rather than directly via the operating handle 14. Thus, an operating handle 14 without the web 60 could not turn the operating shaft 12 separately from the operator selector disc 20. Additionally, in a specific embodiment, the operation selector disc 20 is affixed to the operating shaft 12 such that it is not easily removed, at least not with ordinary tools. For example, if a set screw 48 at threaded passage 47 is used to affix the operation selector disc 20 to the operating shaft 12, a non-standard driving head for the set screw 48 is utilized, such as a pentahead etc.

Figure 13:
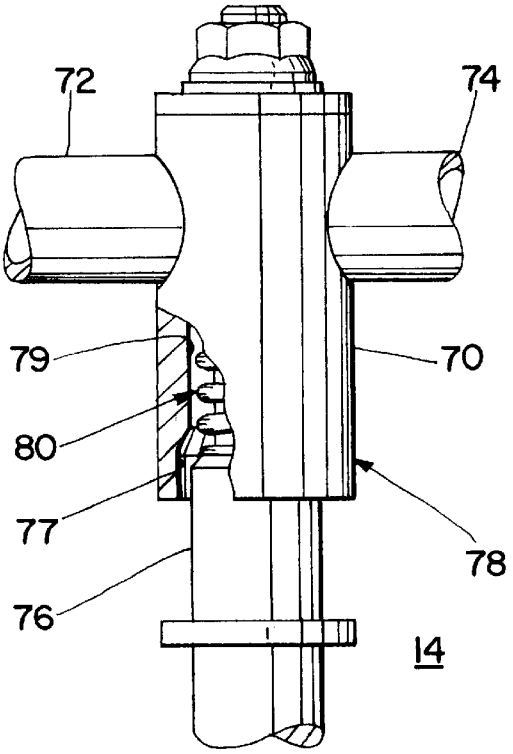
FIG. 13 is an elevational view, partly in section, of a specific embodiment of the operating handle of FIGS. 2, 3, 9 and 10.
Figure 10:
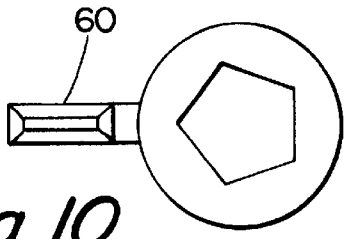
FIG. 10 is a bottom elevational view of the operating handle of FIG. 9.
Figure 11:
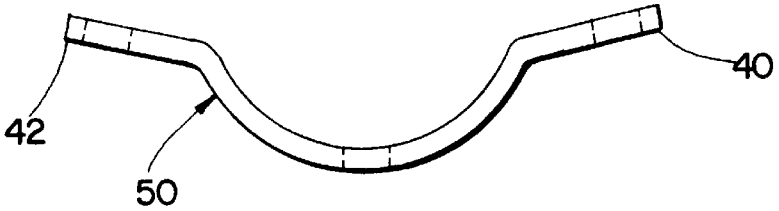
FIG. 11 is a top plan view of a stop ring of the operation selector arrangement of FIGS. 1–3.
Figure 12:
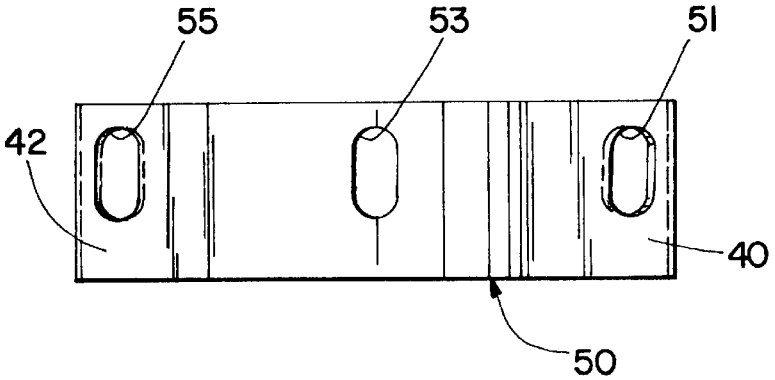
FIG. 12 is a front elevational view of the stop ring of FIG. 11.

Referring now additionally to FIG. 13, a specific embodiment of the operating handle 14 includes a selective drive feature at the upper portion 70, such that the grasping portions 72, 74 of the upper portion 70 of the operating handle 14 may be rotated without rotation of the lower portion 76 of the operating handle 14. Specifically, the lower portion 76 includes a polygonal cross section which cooperates with the inside of a sleeve 78 having a like internal polygonal cross-section at 79 and a widened internal cross-section at the lower end 77. The upper portion 70 is slidably mounted with respect to the lower portion 76 and biased upwardly by a spring 80. Thus, the grasping portion 72, 74 may be rotated to a convenient position independent of the lower portion 76 of the operating handle 14, such that the grasping position may be conveniently adjusted without attempting to drive the operating shaft 12. After a comfortable position has been achieved, the user pushes down on the upper portion 70 whereupon the portion 77 engages the portion 76 so as to drive and rotate the lower portion 76 and the engaged operating shaft 12, as shown in FIGS. 2 and 3.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. An operation selector arrangement for an operating mechanism that is controlled by rotation of an operating member between at least three predetermined operating positions, the operation selector arrangement comprising:

an operating handle arranged to interfit with and rotate the operating member; and blocking means relatively movable with respect to the operating member and said operating handle and cooperating with said operating handle for permitting rotation of the operating member between first and second of the predetermined operating positions and between second and third of the predetermined operating positions, and also preventing rotation of the operating member between the first and third predetermined operating positions, said blocking means comprising a blocking member movable with respect to the operating member to establish two predetermined blocking positions and means for restricting movement of said blocking member so that said blocking member is movable only between two predetermined blocking positions in a first of said two predetermined blocking positions said blocking member preventing rotation of the operating member between the first and second predetermined operating positions when the operating member is rotated relative to said blocking member and out of the third predetermined operating position, in a second of said two predetermined blocking positions said blocking member preventing rotation of the operating member between the second and the third predetermined operating positions when the operating member is rotated relative to said blocking member and out of the first predetermined operating position, said operating handle comprising means for preventing rotation of the operating member via interference between said blocking member and said operating handle.

2. The operation selector arrangement of claim 1 further comprising first means for selectively securing said blocking member against movement in said first or second predetermined blocking position.

3. The operation selector arrangement of claim 1 further comprising means for defining a predetermined relative position of said operating handle with respect to the operating member wherein said operating handle interfits with the operating member.

4. An operation selector arrangement for an operating mechanism that is controlled by movement of an operating member between at least three predetermined operating positions, the operation selector arrangement comprising blocking means being selectively operable for permitting movement of the operating member between first and second of the predetermined operating positions and between second and third of the predetermined operating positions, and also preventing movement of the operating member between the first and third predetermined operating positions, said blocking means comprising a blocking member and means for restricting movement of said blocking member so that said blocking member is movable only between two predetermined blocking positions, said blocking member being relatively pivotably mounted with respect to the operating member and arranged to interfere with and block movement of the operating member between the first and third predetermined operating positions whereby with said blocking member pivoted into a first of said two predetermined positions the operating member is movable relative to said blocking member between the first and second predetermined operating positions, and with said blocking member being pivoted into said second of said two predetermined positions the operating member is movable relative to said blocking member between said second and third predetermined positions.

5. An operation selector arrangement for an operating mechanism that is controlled by rotation of an operating member between at least three predetermined operating positions, the operation selector arrangement comprising:

an operating handle; and operation selection means, said operating handle and said operation selection means comprising first means for defining a predetermined drive position of said operating handle with respect to the operating member in which said operating handle is arranged to rotate the operating member via said operation selection means, said operation selection means further comprising blocking means cooperating with said operating handle for permitting rotation of the operating member between first and second of the predetermined operating positions and between second and third of the predetermined operating positions, and also preventing rotation of the operating member between the first and third predetermined operating positions, said blocking means comprising a blocking member movable with respect to the operating member between two predetermined blocking positions and means for restricting movement of said blocking member so that said blocking member is movable only between two predetermined blocking positions in a first of said two predetermined blocking positions said blocking member preventing rotation of the operating member between the first and second predetermined operating positions when the operating member is rotated out of the third predetermined operating position and relative to said blocking member, in a second of said two predetermined blocking positions said blocking member preventing rotation of the operating member between the second and the third predetermined operating positions when the operating member is rotated out of the first predetermined operating position and relative to said blocking member, said operating handle comprising second means for preventing rotation of the operating member via interference between said blocking member and said operating handle.

6. The operation selector arrangement of claim 5 further comprising means for selectively retaining said blocking member against movement in one of said two predetermined blocking positions.

7. The operation selector arrangement of claim 6 wherein said second means is a first extending portion of said operating handle.

8. The operation selector arrangement of claim 7 wherein said operation selection means comprises an operation selection member and said first means comprises a second extending portion of said operating handle that interfits with an opening in said operation selection member.

9. The operation selector arrangement of claim 8 wherein said first and second extending portions of said operating handle are defined by a web extending from said operating handle.

10. The operation selector arrangement of claim 5 wherein said operation selector means comprises an operation selector member and means for selectively securing said operation selector member against movement.

11. The operation selector arrangement of claim 10 further comprising means for selectively retaining said blocking member against movement in one of said two predetermined blocking positions.

* * * * *